US005248085A

United States Patent [19]

Jensen et al.

[11] Patent Number: 5,248,085

[45] Date of Patent: Sep. 28, 1993

[54] GAS BOILER

[75] Inventors: Niels D. Jensen, Bjerringbro, Denmark; Horst Komossa, Wittenborn, Fed. Rep. of Germany; Thomas Blad, Bjerringbro, Denmark

[73] Assignee: Grundfos A/S, Bjerringbro, Denmark

[21] Appl. No.: 927,693

[22] Filed: Aug. 7, 1992

[30] Foreign Application Priority Data

Aug. 23, 1991 [DE] Fed. Rep. of Germany ..... 4127822

[51] Int. Cl.[5] ..... F24D 3/08

[52] U.S. Cl. ..... 237/19; 237/8 R

[58] Field of Search ..... 237/8 R, 19, 8 C; 236/20 R; 126/101, 362

[56] References Cited

U.S. PATENT DOCUMENTS 4,709,854 12/1987 Biagini et al. ..... 237/19 X

FOREIGN PATENT DOCUMENTS 0394140 10/1990 European Pat. Off. .

*Primary Examiner*—Henry Bennett

*Attorney, Agent, or Firm*—Panitch Schwarze Jacobs & Nadel

[57] ABSTRACT

The gas boiler is intended for room heating and producing hot water and has a gas-heated primary heat exchanger which feeds two heating circuits lying in parallel. The heat exchange medium is circulated via a rotary pump driven by an electric motor, arranged on the cold side of the primary heat exchanger and has a control mechanism which is arranged on the pressure side and controlled by speed or direction of rotation. This control mechanism serves to actuate a switch mechanism connected to the pump housing, in that it connects in series one or other heating circuit to the primary heat exchanger. The switch mechanism is arranged on the hot side of the primary heat exchanger in the pipework to the heating circuits.

13 Claims, 7 Drawing Sheets

GAS BOILER

Figure 1:
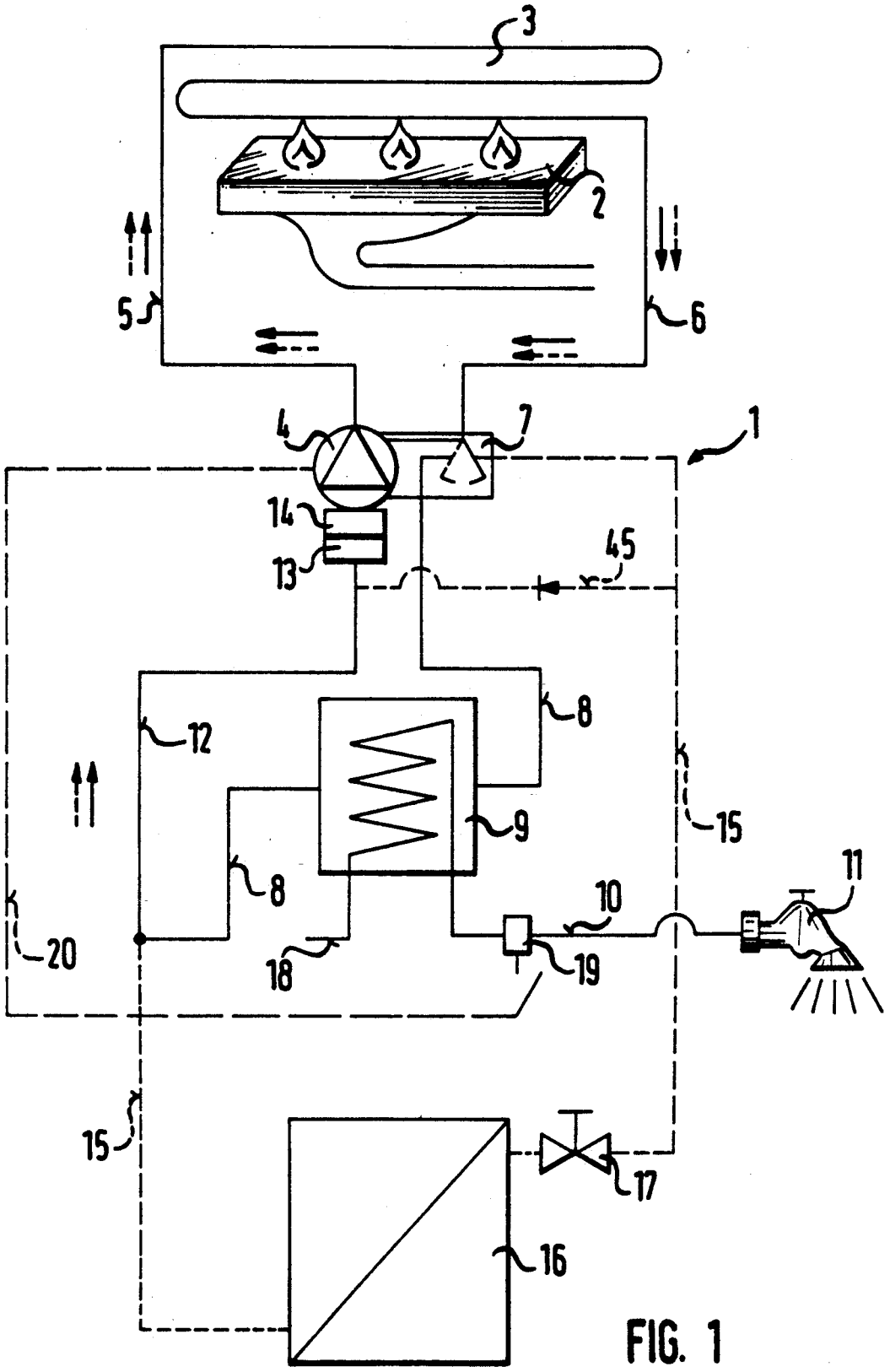

The invention relates to a gas boiler for room heating and producing hot water having a gas-heated primary heat exchanger and two heating circuits lying in parallel and having a rotary pump arranged on the cold side of the primary heat exchanger and driven by an electric motor, which pump has a speed-controlled or rotary direction-controlled control mechanism arranged on the pressure side to actuate a switch mechanism connected to the pump housing, which switch mechanism connects in series one or other heating circuit to the primary heat exchanger.

Gas boilers are practised state of the art and are used, for example where heating installations and hot-water boilers have to be installed in a confined space. Apparatus of this type are used in particular when renovating old buildings and in apartments. They comprise a gas-heated primary heat exchanger which feeds two heating circuits, namely that for room heating and that for producing hot water, which are connected in parallel and in which the water is circulated by means of a rotary pump. The primary heat exchanger is connected here so that it feeds either the one or the other as a circuit. A plurality of valves, controllers, sensors and the like are required for this in the gas boilers which are used conventionally today. These part water-conducting and/or flow-conducting components lead to a relatively complicated construction for the gas boiler with correspondingly high production costs. As a result of the large number of these components provided at different points within the gas boiler, they are often difficult to access, which makes maintenance and repair work of the gas boiler unnecessarily expensive.

Attempts have been made to simplify the construction of such a gas boiler by using two circulating pumps which operate independently of one another. However, the expected savings have not materialised in practice, since when using two circulating pumps care must be taken to ensure that the circulating pump used for producing hot water has priority over that for the heating circuit, for which a relatively complex circuit and pipework for both pumps is required.

Furthermore, pumps are known from European application 0 394 140 which should lead to simplification of the gas boiler system and are equipped with a pressure fitting and two intake fittings. In these pumps, a control mechanism lies between the impeller and the pressure fitting such that one or other intake fitting is isolated by a switch mechanism via lever mechanisms depending on the direction of rotation of the impeller, as a result of which the conveying stream should be steered through the room heating or domestic water heating circuit. Each switch mechanism lying on the intake side of the pump causes pressure losses, increases the NPSH value and leads to increased danger of noise build-up in the case of heating pumps, particularly as a result of cavitation. Since in this proposed solution there is excess pressure in the isolated pipe compared to the intake space of the pump, thus producing a pressure difference at the switch mechanism which corresponds to the pressure difference between the branching point of the heating circuits and the intake space of the pump, the surface ratio between control mechanism and switch mechanism and the length ratio of the double-armed lever can no longer be freely selected. The constructive solution is complicated and the closing force at the switch mechanism operating against the excess pressure is low, such that the reliability of the conveying stream control is not reliably guaranteed for the low-power pumps which are conventional here.

The object of the invention is to design a generic gas boiler, such that reliable, low-maintenance conveying stream control is guaranteed and the danger of noise build-up is reduced, starting from a gas boiler having a pump, as is known from European patent application 0 349 140. In a further embodiment of the invention, low-cost production and assembly should be achieved. Finally, the pump required for this should be provided.

This is achieved in accordance with the invention in that the switch mechanism lies on the hot side of the primary heat exchanger in the pipework to the heating circuits.

The solution according to the invention has the advantage that the danger of noise build-up is considerably reduced due to the arrangement of the switch mechanism on the hot side of the primary heat exchanger. The solution according to the invention avoids the disadvantages mentioned and makes reliable switching possible between the two heating circuits with simple and hence low-cost gas boiler construction. Since the pressure difference existing at the shaft of the switch mechanism is considerably lower than that at a comparable switch mechanism according to the generic state of the art, a special sealing of the shaft may be dispensed with as a rule. The friction losses are thus considerably lower when connecting the switch mechanism, and this reduces the switching forces and hence increases the reliability of switching. Hence the solution according to the invention is also reliable for pump units in the power range below 100 watts.

Further advantageous embodiments of the invention can be seen in the further claims, the description below and the figures.

The embodiment of the gas boiler of the type, in which a part of the pressure difference produced by the pump acts as a closing force at the switch mechanism, is preferred. An embodiment of this type may occur by appropriate selection of the switch mechanism, in which a flap valve or a seat valve is used, for example as a switch mechanism, instead of a slide valve. An embodiment of this type increases the switching reliability, since the particular switch position is fluid-assisted.

A particularly advantageous construction is produced when the switch body of the switch mechanism is arranged in a chamber of the pump housing, which is separated from the conveying stream flowing directly through the pump. This means that the instantaneous conveying stream flowing through the pump is separated from the stream flowing instantaneously through the chamber, even if the latter is the same fluid stream. An embodiment of this type is in practice a structural unit comprising pump and valve, wherein the valve is controlled by the flow forces of the pump.

It is particularly advantageous when the switch mechanism has a closing body which is connected to a shaft guided through a wall in the pump housing, with which shaft the control mechanism is connected to be resistant to rotation. This wall then separates the conveying stream flowing directly through the pump from the conveying stream flowing through the chamber. Passing the shaft through the wall ensures only low over-flow losses even without sealing because of the relatively low pressure difference. The components for achieving the required switching forces may be adapted accordingly by selecting the shape and size of the closing body or of the control mechanism and optionally of the levers, by means of which they sit on the shaft.

In terms of construction it is advantageous if the control mechanism and the closing body of the switch mechanism form a structural element with the shaft, which structural element forms an assembly unit together with an intermediate wall of the pump housing penetrated by the shaft and a pipe section on the intake side of the pump, which assembly unit is incorporated into the pump housing in a compression-resistant and sealing manner. An assembly unit of this type may be advantageously produced and pre-assembled and then inserted into the pump housing. In the case of maintenance and repair work, the components may be dismantled with little effort.

A preferred embodiment is one in which the assembly unit is designed as a cartridge which can be inserted into the pump housing. A cartridge of this type essentially designed as a cylindrical body may be sealed within the pump housing using simple means and processed at low cost because of the round external contour.

A pump unit designed for the boiler according to the invention is characterised by the features listed in the applicable claims. A pump unit of this type is preferably suited for use in gas boilers. However, its use is not limited to this, the pump unit may also be used, for example in other heating installations, in solar heating installations and the like. It may also be used where the switch mechanism controls a fluid stream which is completely independent of the conveying stream of the pump and separated therefrom.

The invention is illustrated below using exemplary embodiments shown in the figures.

Figure 2:
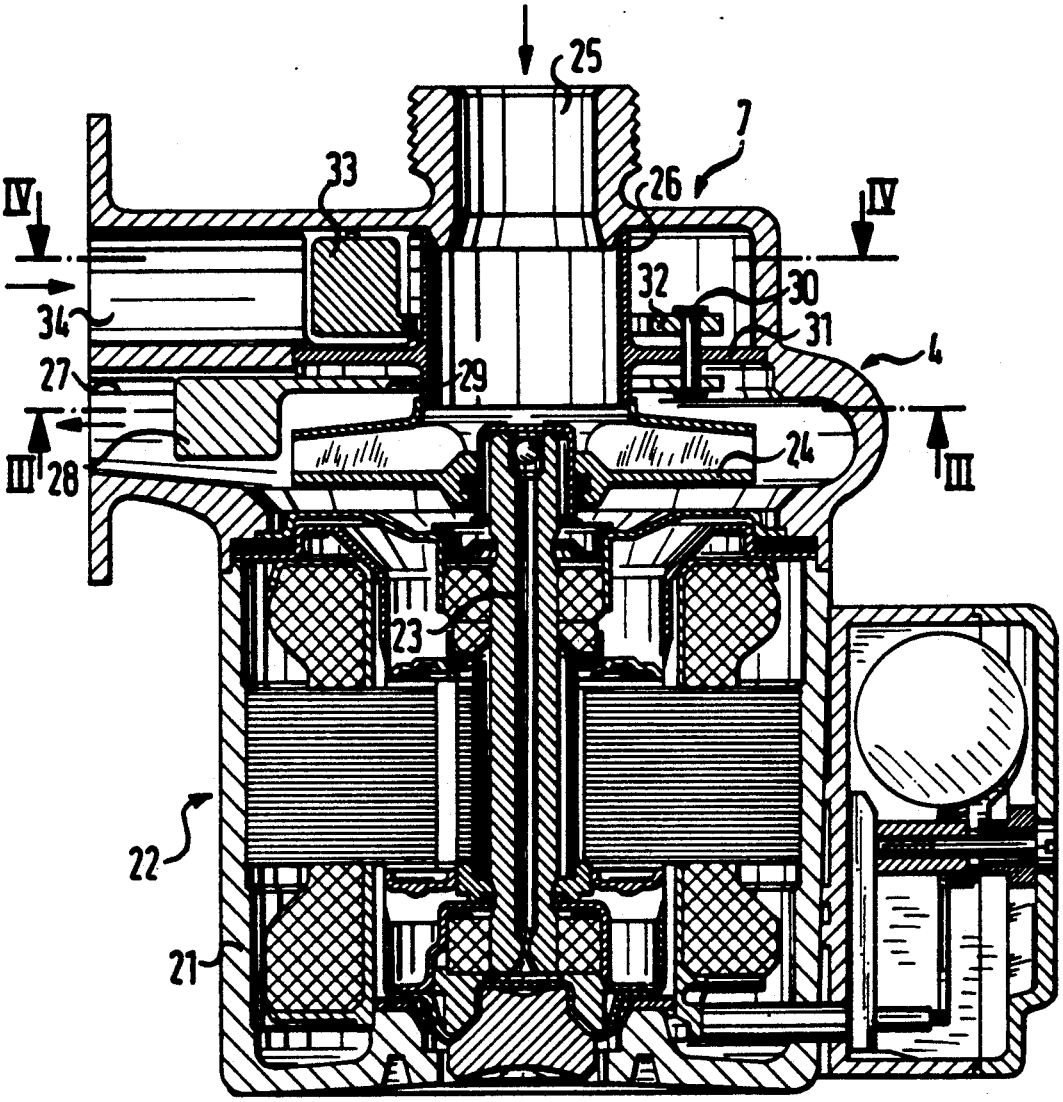
Figure 3:
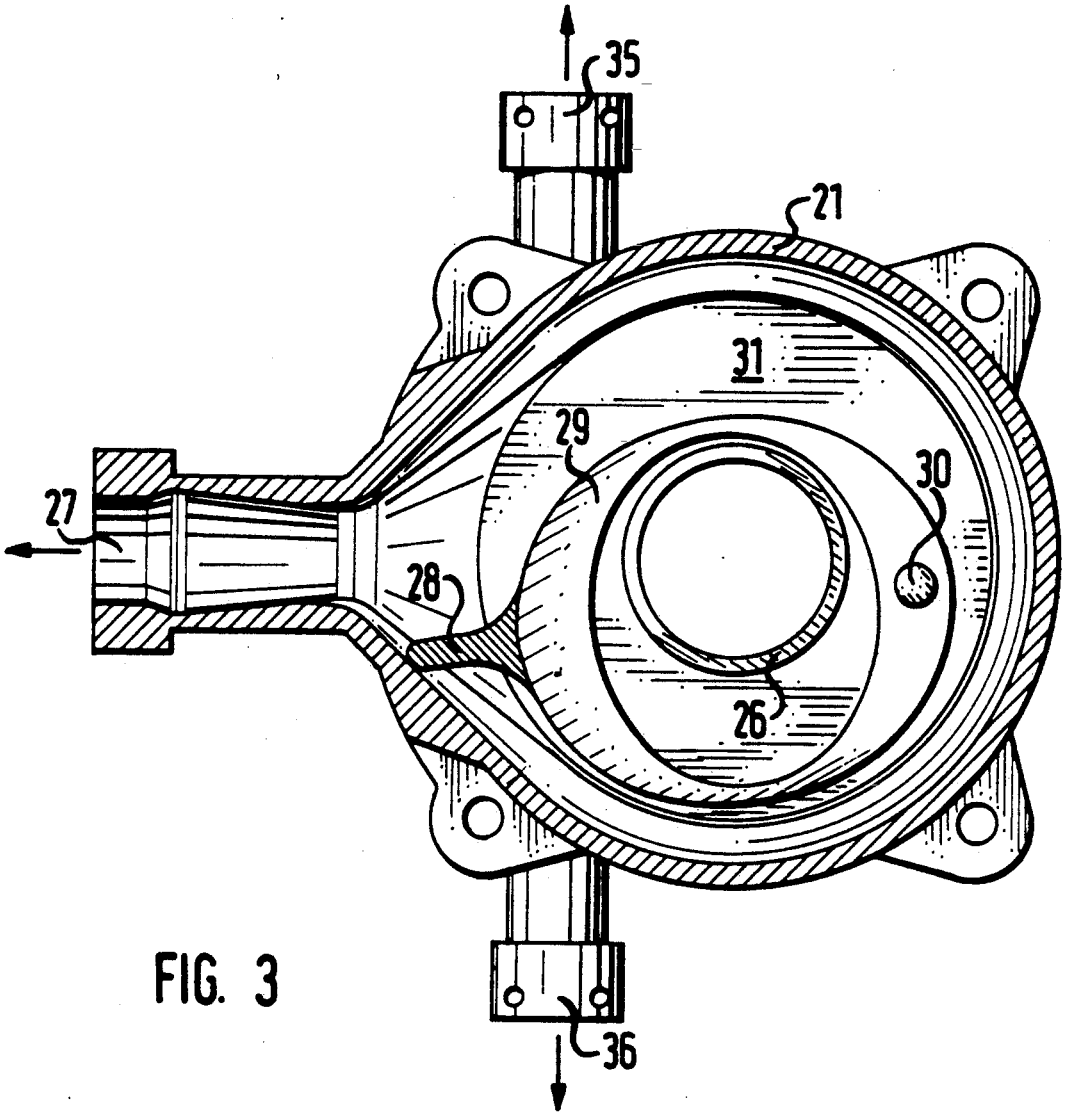
Figure 4:
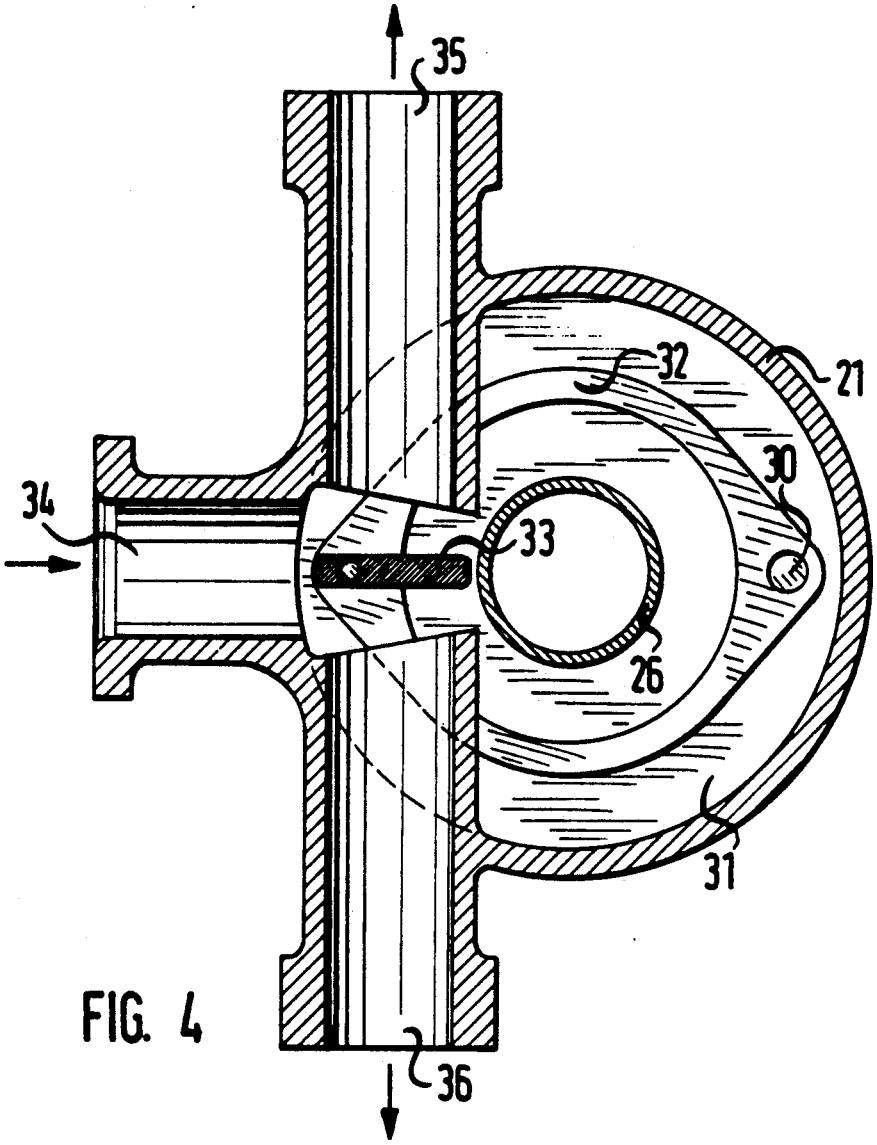
Figure 5:
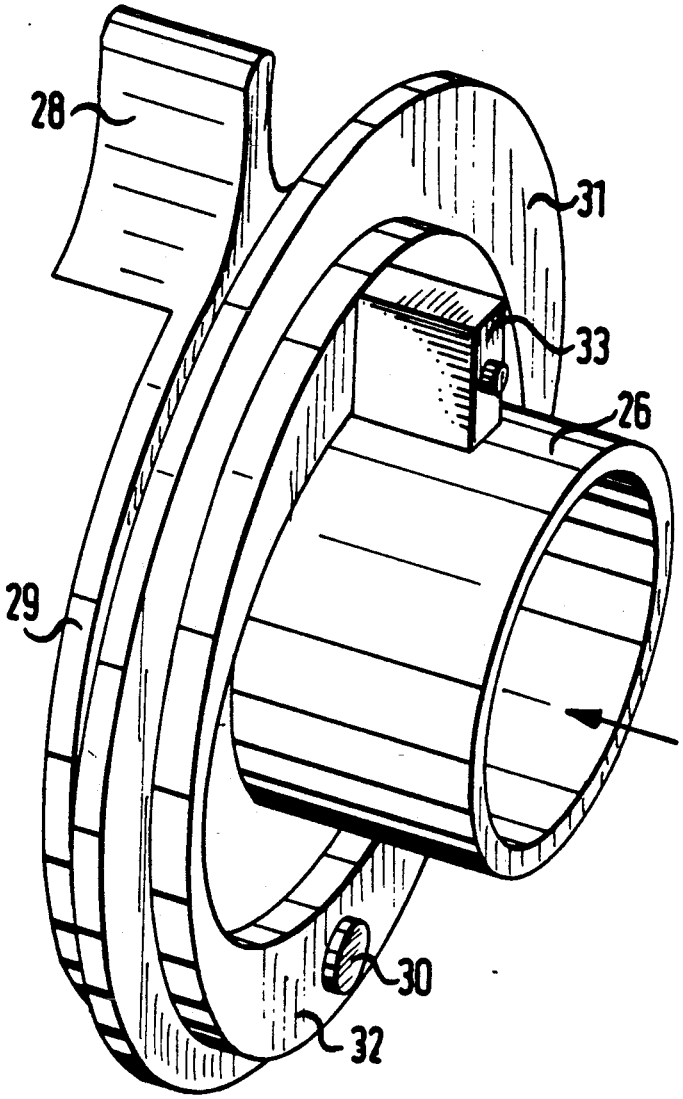
Figure 6:
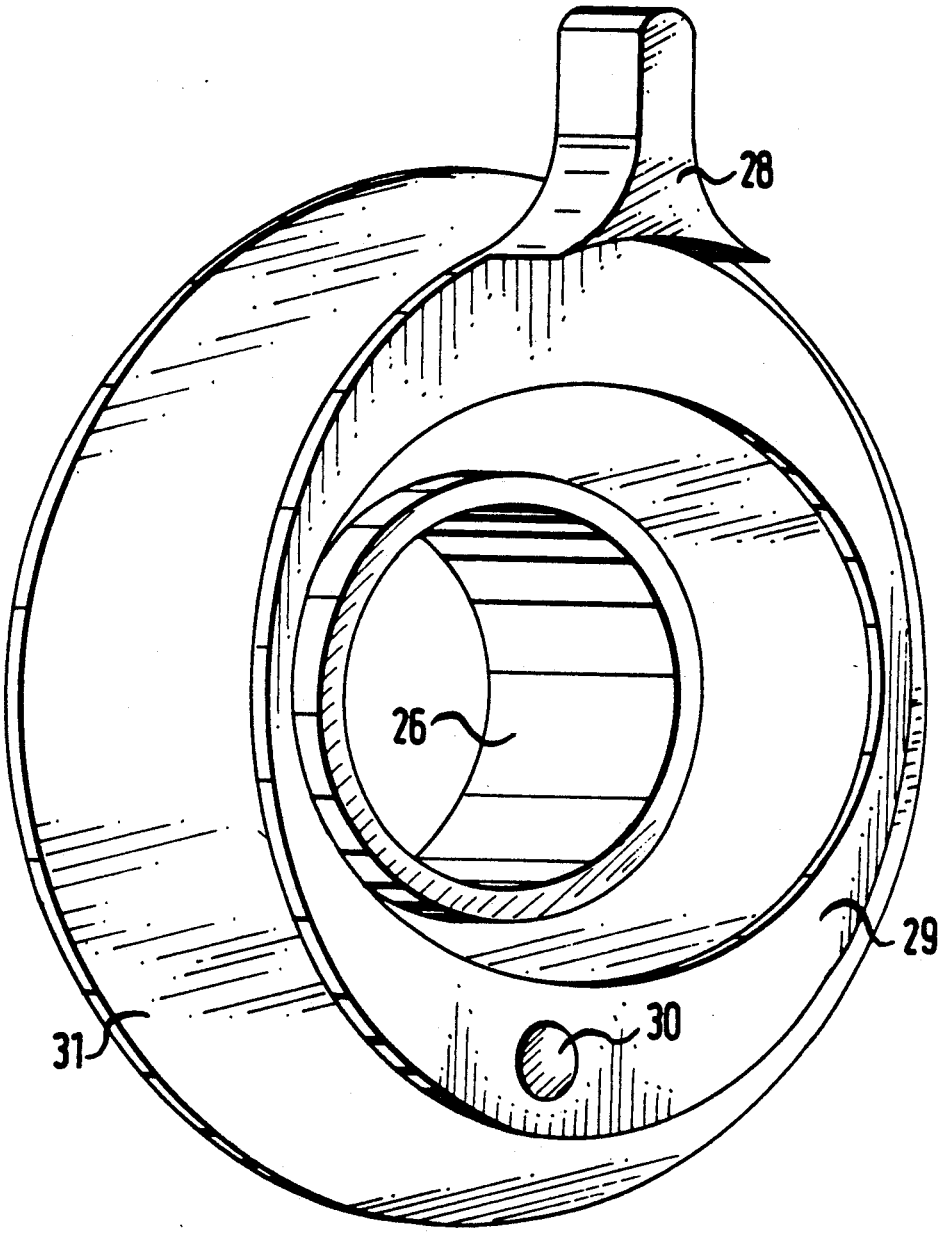
Figure 7:
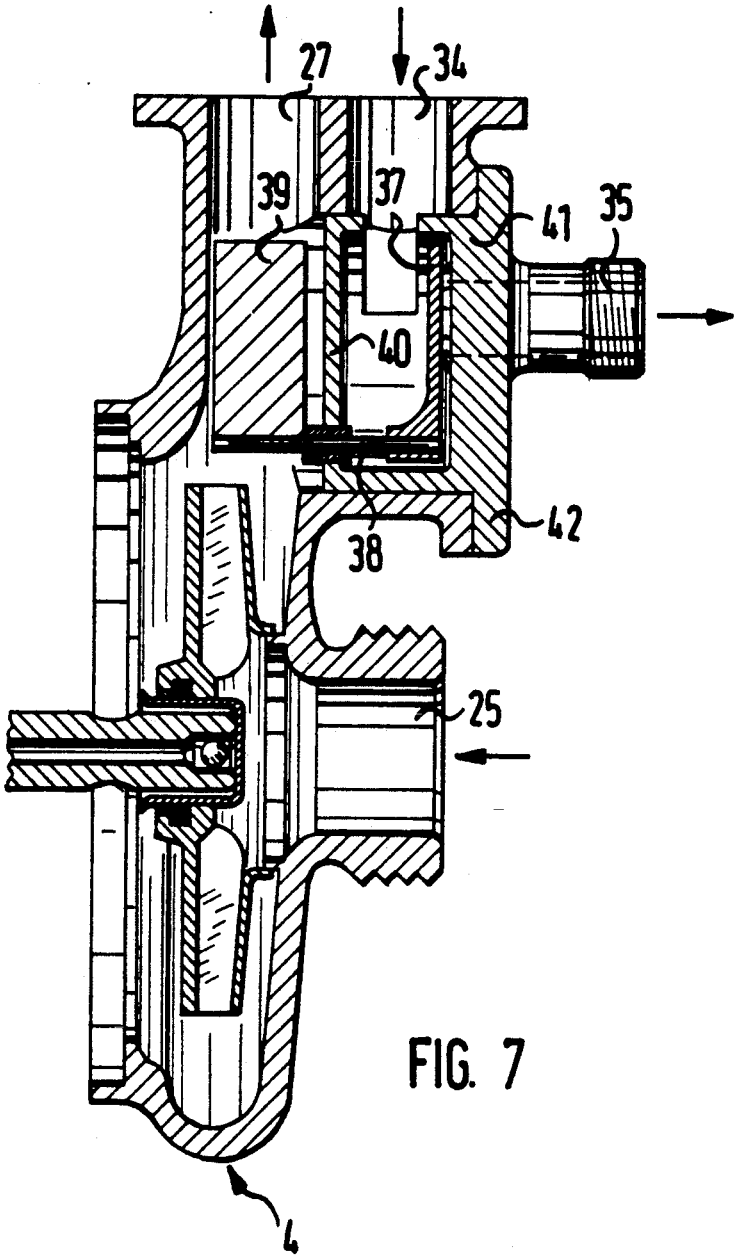

FIG. 1 shows a schematic representation of the construction of a gas boiler,

FIG. 2 shows a longitudinal section through a pump unit with integrated switch mechanism of the gas boiler according to FIG. 1, FIG. 3 shows a section along the section line III—III in FIG. 2, FIG. 4 shows a section along the section line IV—IV in FIG. 2, FIG. 5 shows an enlarged perspective view of an assembly unit of the pump unit according to FIG. 2, FIG. 6 shows a perspective representation of the assembly unit according to FIG. 5 in rear view, and FIG. 7 shows a longitudinal section through a further embodiment of the pump unit represented according to FIG. 2.

The gas boiler 1 shown in FIG. 1 has a gas burner 2, a primary heat exchanger 3 which can be heated by it and a rotary pump 4. The rotary pump 4 is installed on the cold side of the primary heat exchanger 3, it pushes the conveying stream through the pipe 5 into the primary heat exchanger.

The water heated in the primary heat exchanger 3 then flows through a pipe 6 to a switch mechanism 7 combined with the pump 4 to form a structural unit. The switch mechanism 7 connects the pipe 6 to one of two heating circuits.

The domestic water heating circuit is shown in full lines and shown as 8. A secondary heat exchanger 9, in which the domestic water to be heated is heated and fed to a removal point 11 via the pipe 10, is incorporated into this heating circuit 8. This heating circuit 8 is connected to a dirt collector 13 connected upstream of the pump 4 via a pipe 12 and to an air separator 14 incorporated between dirt collector and pump. The water leaving the secondary heat exchanger 9 is thus supplied to the heating circuit 8 via the pipe 12 to the intake fitting of the pump 4 and through this back to the primary heat exchanger 3 and then re-heated through the pipe 6.

The switch mechanism 7 is switched over by changing the direction of rotation of the rotary pump 4, so that the inlet to the heating circuit 8 is isolated and the pipe 6 coming from the primary heat exchanger 3 is connected to the other heating circuit 15 shown as a broken line. This heating circuit 15 has one or more secondary heat exchangers 16 in the form of heating bodies, upstream of which a thermostatically controlled valve 17 is connected, as is conventional today for room heating installations. The heating circuit 15 merges into pipe 12 which supplies it via the dirt collector 13, the air separator 14 and the pump 4 of the pipe 5 leading to the primary heat exchanger 3 and then heated to the pipe 6 and hence supplies this heating circuit 15 again. The valve 17 is connected to the outlet of the heating circuit 15 in a manner known per se via a by-pass pipe 45 to avoid the secondary heat exchanger 16, so that the heating circuit 15 is not interrupted even when the valve 17 is closed.

The mode of operation of the gas boiler described above is as follows: In conventional room heating operation, the heating circuit 15 is connected in series to the primary heat exchanger 3 via the switch mechanism 7, the heat transfer medium is circulated by means of the pump 4. The switch mechanism 7 isolates the heating circuit 8 at this point. In the case of removing water at the removal point 11, the pressure falls within the pipe 10 connected to the supply network 18 via the secondary heat exchanger 9. A sensor 19 with control device, which detects this sudden fall in pressure and then instructs the pump 4 to reverse the direction of rotation, sits within the pipe 10. This control function is shown as 20 in FIG. 1. The switch mechanism 7 is reversed by reversing the direction of rotation of pump 4, so that the pipe 6 is then connected to the heating circuit 8 and the heating circuit 15 is isolated at the switch mechanism 7. As a rule the installation is then operated at higher capacity, since a high thermal capacity is required for heating the domestic water. As soon as the removal process is completed, it is in turn recorded by the sensor 19, the switch device is reversed so that the pump 4 once again is instructed to reverse the direction of rotation and the switch mechanism 7 falls back into its original switch state, in which the heating circuit 15 is connected in series to the primary heat exchanger 3.

The switch mechanism 7 may also be designed such that the switching function does not occur during reversing of the direction of rotation but during a change in speed, wherein the switching function is then selected so that at higher speed the domestic water heating circuit 8 is instructed to open.

FIG. 2 shows a section of the pump unit, comprising the pump 4 and the switch mechanism 7, consisting of a housing 21, in which an electric motor 22 is arranged, the shaft 23 of which drives an impeller 24. The intake fitting 25 of the pump 4 is arranged coaxially to the shaft 23 and passed through the switch mechanism 7 by means of a pipe section 26. The pressure fitting is designated 27 in FIG. 2, it lies radially to the impeller 24. A control mechanism 28, which is formed by a blade lying within the flow path, is arranged within the pressure fitting 27, which blade occupies a different position depending on the direction of rotation of the impeller 24. The control mechanism 28 is connected to a shaft 30 via a lever 29, which shaft 30 is passed rotatably through a wall 31 in the pump housing and to the other end of which, situated within the switch mechanism 7, a lever 32 is attached. A closing body 33, which connects the inlet 34 of the switch mechanism 7 (see FIG. 4) to one or other outlet 35, 36 of the switch mechanism 7 or isolates one or other outlet of the switch mechanism, is arranged at the free end of the lever 32.

In the exemplary embodiments described above, the pipe section 26 and the intermediate wall 31 are designed to be integral and are inserted into the pump housing, in particular as an assembly unit together with a structural unit formed from control mechanism 28, shaft 30 and closing body 33 with the associated levers 29 and 32. This assembly unit is shown in perspective in FIGS. 5 and 6. The levers 29 and 32 have an annular shape, wherein the inner recess has an elliptical shape to surround the pipe section 26 without contact in both switch positions.

The closing body 33 is arranged within the flow path of the heating circuits of the gas boiler 1, such that the switch positions are force-assisted by the streams, so that the retaining forces to be applied by flow dynamics via the control mechanism 28 may be comparatively low.

FIG. 7 shows a further embodiment, in which a slide 37, which sits on a shaft 38, is disposed in place of the closing body 33, and on the other end of a shaft 38 a control mechanism 39 is arranged. The shaft 38 is mounted within an intermediate wall 40, which sits in a corresponding recess in the pump housing 21. As can be seen from the drawing, the outlet 35 of the switch mechanism shown in FIG. 7 is arranged parallel to the intake fitting of the pump 4. In this embodiment also, slide 37, shaft 38 and control mechanism 39 form a structural unit, which together with the wall 40 and a housing part 41 having the fitting for the outlet 35, is designed as an assembly unit in the form of a cartridge which can be inserted into the housing 21. The wall 40 and the housing part 41 are connected to one another and form an approximately cylindrical body, the outer flange 42 of which is connected to the housing 21 by means of screws (not shown). A cartridge-like assembly unit of this type is particularly favourable to produce and is simple to assemble, in particular there are virtually no sealing problems due to the cylindrical design.

FIG. 7 only shows the outlet 35, the second outlet of the switch mechanism lies parallel to the outlet 35, so that the slide 37 closes either the outlet 35 or the other outlet (not shown) when the shaft 38 is rotated about its longitudinal axis. The switch positions of the switch mechanism are essentially free of flow forces in this embodiment.

We claim:

1. A gas boiler for room heating and for producing hot water, the gas boiler comprising a gas-heated primary heat exchanger and two heating circuits connectable to the primary heat exchanger by a switch mechanism, the gas boiler having a pump arranged on a cold side of the primary heat exchanger, said pump being driven by a motor, the pump having a control mechanism arranged on a pressure side of the pump to actuate the switch mechanism, the switch mechanism being connected to a housing of the pump such that the switch mechanism connects one or the other heating circuit to the primary heat exchanger, wherein the switch mechanism is positioned on a hot side of the primary heat exchanger between the primary heat exchanger and the heating circuits.

2. A gas boiler according to claim 1, wherein the pump produces a pressure difference at least a part of which acts as a closing force at the switch mechanism.

3. A gas boiler according to claim 1, wherein the switch mechanism comprises a switch body arranged in a chamber of the pump housing which is separated from conveying stream flowing directly through the pump.

4. A gas boiler according to claim 1, wherein the switch mechanism comprises a closing body which is connected to a shaft extending through a wall in the pump housing, the control mechanism being connected to the shaft such as to be resistant to rotation.

5. A gas boiler according to claim 1, wherein the switch mechanism comprises a closing body, and wherein the control mechanism and the closing body form a structural element with a shaft, the structural element, an intermediate wall of the pump housing, and a pipe section on an intake side of the pump collectively form an assembly unit which is incorporated into the pump housing in a compression-resistant and sealing manner.

6. A gas boiler according to claim 5, wherein the assembly unit comprises a cartridge insertable into the pump housing.

7. A pump unit comprising a pump driven by a motor, the pump unit also comprising a control mechanism arranged on a pressure side of the pump unit to actuate a switch mechanism, the switch mechanism being connected to a housing of the pump, wherein a switch body of the switch mechanism is arranged in a chamber of the pump housing which is separated from conveying stream flowing directly through the pump.

8. A pump unit according to claim 7, wherein the switch mechanism comprises a closing body connected to a shaft, the shaft extending through a wall in the pump housing, the control mechanism being connected to the shaft such as to be resistant to rotation.

9. A pump unit according to claim 8, wherein the control mechanism and the closing body form a structural element with the shaft, the structural element, an intermediate wall of the pump housing, and a pipe section on an intake side of the pump collectively form an assembly unit which is incorporated into the pump housing in a compressor-resistant and sealing manner.

10. A pump unit according to claim 9, wherein the assembly unit comprises a cartridge insertable into the pump housing.

11. A gas boiler according to claim 1, wherein the control mechanism is rotary direction-controlled.

12. A pump unit according to claim 7, wherein the control mechanism is rotary direction-controlled.

13. A pump unit according to claim 7, wherein the pump unit forms part of a gas boiler.

* * * * *